United States Patent [19]

Warfman

[11] Patent Number: 4,967,576

[45] Date of Patent: Nov. 6, 1990

[54] SECURITY CABINET, IN PARTICULAR FOR THE MANAGEMENT OF MEANS OF ACCESS OR OTHER CONTROLLED-USE OBJECTS

[76] Inventor: Daniel Warfman, 25 rue de Fontarabie, 75020 Paris, France

[21] Appl. No.: 342,859

[22] Filed: Apr. 25, 1989

[30] Foreign Application Priority Data

Apr. 25, 1988 [FR] France ..... 88 05461

[51] Int. Cl.[5] ..... E05B 65/52

[52] U.S. Cl. ..... 70/63; 70/277; 70/278

[58] Field of Search ..... 70/63, 277–279, 70/256

[56] References Cited

U.S. PATENT DOCUMENTS

| | | | |
|---|---|---|---|
| 3,455,127 | 7/1969 | Simon | 70/277 |
| 3,873,892 | 3/1975 | Dettling et al. | 70/278 X |
| 4,462,317 | 7/1984 | Franko et al. | 70/63 X |
| 4,468,409 | 9/1984 | Davis | 70/63 |
| 4,615,281 | 10/1986 | Gaston | 70/63 X |
| 4,631,358 | 12/1986 | Newcome, III | 379/45 |
| 4,649,833 | 3/1987 | Cummins | 70/278 X |
| 4,673,915 | 6/1987 | Cobb | 340/330 |
| 4,727,368 | 2/1988 | Larson et al. | 70/63 X |
| 4,763,937 | 8/1988 | Sittnick, Jr. et al. | 70/277 X |
| 4,766,746 | 8/1988 | Henderson et al. | 70/63 |
| 4,768,021 | 8/1988 | Ferraro | 70/63 X |
| 4,838,052 | 6/1989 | Williams et al. | 70/277 X |

FOREIGN PATENT DOCUMENTS

| | | | |
|---|---|---|---|
| 0000744 | 2/1979 | European Pat. Off. . | |
| 0086617 | 8/1983 | European Pat. Off. . | |
| 0104072 | 3/1984 | European Pat. Off. . | |
| 2717726 | 10/1978 | Fed. Rep. of Germany | 70/277 |
| 2902193 | 7/1980 | Fed. Rep. of Germany . | |
| WO8606858 | 11/1986 | PCT Int'l Appl. . | |
| 1402708 | 8/1975 | United Kingdom | 70/277 |
| 2119548 | 11/1983 | United Kingdom | 70/277 |

*Primary Examiner*—Robert L. Wolfe
*Assistant Examiner*—Suzanne L. Dino
*Attorney, Agent, or Firm*—Fleit, Jacobson, Cohn, Price, Holman & Stern

[57] ABSTRACT

A security cabinet comprising a compartment (1) equipped at the front with a door (6) which is normally closed by a bolt (40) released by at least one electromagnet (39) activated under the effect of a means of opening the door (38, 49, 50, 53), and a back plate (3) opposite the door.

The security cabinet further comprises, arranged inside the compartment (1) on an intermediate plate (16), which is parallel but separate from the back of this compartment, at least one housing (29) for receiving at least one protected means of access (30) or another similar object which may be withdrawn from its housing only after the opening of the door and the releasing of a protective shutter (31) of the said means of access, the intermediate plate (16) carrying members for the control and counting (23, 24, 25, 26) of the movements of the means of access with respect to its housing and for verifying predetermined parameters capable of authorizing the withdrawal of this means and then controlling its correct replacing before closure of the door.

13 Claims, 3 Drawing Sheets

SECURITY CABINET, IN PARTICULAR FOR THE MANAGEMENT OF MEANS OF ACCESS OR OTHER CONTROLLED-USE OBJECTS

The present invention relates to a security cabinet which makes it possible to control and to manage the use of means, in particular such as keys, badges, magnetic cards or the like, which give access to premises or enclosures, cupboards or similar closed bodies by providing, in particular, detailed and complete information, for example, on the movements and the use of these means, the identity of the users, the times and the durations of these uses and any other parameters desirable for ensuring thorough monitoring thereof. Similarly, the invention applies to the management of similar objects in order to control the use of the latter solely by the authorized persons under predetermined conditions.

Currently, it is conventional to have, inside a cabinet equipped with a window or other screen of the same type, a key which is necessary for opening an access door to a premises or a closed enclosure. In order to allow the user to take this key in order to open the premises closed by the door, it is usually essential to have an ordinary key or other similar means of opening in order to give access to the inside of the cabinet or, alternatively, in the event of an emergency, to break the window of the latter, making it possible, only at the time of this opening, to warn, if necessary, a central control. In particular, these rudimentary systems make it absolutely impossible to manage the movements of the key contained in the cabinet and, in particular, to know who has taken the latter, at what time, for what use and, also, at what time it has been returned and, once again, by whom. Similarly, these systems do not allow differentiation of the passes, held by certain persons and not by others, for taking and using the key available in the cabinet, according to the times or the destination of the key. By way of indication, reference may, in particular, be made in respect of these known systems to those described in the published European Patent Application Nos. EP-A-0,104,072 or EP-A-086,617 which illustrate security cabinets for keys or similar objects but which do not allow full management of the movements of these keys in time and in space, according to their destinations, their modes of use, the identity of their users, the rights of use of the latter and the conditions in which the users are authorized to exercise these rights.

The advantage of the system which, on the other hand, makes it possible to totally control the use and the movements of one or more means of access enclosed in the cabinet or of similar objects may therefore be understood, it being possible for this cabinet to contain one or more of such means or objects arranged side by side and only some of which may be used by specific users, the others being reserved for different users and for equally distinct uses.

The subject of the invention is therefore a security cabinet which makes it possible to authorize temporary access to at least one means of opening housed in the cabinet or to a similar object only on the condition that the user justifies a right of use, authorizing only the opening of this cabinet, the latter being additionally equipped for recording and controlling the movements of one or more means of access or another object by identifying all the parameters characterizing these movements.

To this end, the cabinet in question, comprising a compartment equipped at the front with a door which is normally closed by means of a bolt released by electromagnet placed under tension by a means of opening the door, which means is personalized for the user, and a back plate provided opposite the door, is characterized in that it comprises, arranged inside the compartment on an intermediate plate, parallel but separate from the back of this compartment, at least one housing for receiving at least one protected means of access or other similar object which may be removed from its housing only after opening of the door and releasing of a shutter protecting the said means of access, the intermediate plate carrying members for control and counting of the movements of the means of access with respect to its housing and for verifying predetermined parameters suitable for authorizing withdrawal of this means and then for controlling its correct replacing before closing of the door.

According to a particular characteristic of the cabinet in question, the back of the compartment comprises, towards the inside, fixing brackets supporting studs for anchoring the compartment on a support surface, these studs being associated via their threaded ends, located inside the compartment, with blocking and immobilizing nuts which are not accessible from the outside when the door is closed.

The fixing studs advantageously comprise at the end a drilled hole for the installation of an unbreakable lead seal in order to control any possible wrenching of the cabinet. In addition, the compartment preferably comprises, between its back and the support surface, an electrical contact connected to a central control point, arranged close by or remotely, recording any possible movement of the compartment.

According to another characteristic, the back of the compartment carries a connector block for the passage of electrical connecting conductors through this back which conductors connect the central control point to the set of command and/or control members fitted in the compartment.

In addition, according to another characteristic, the intermediate plate carries, in its face directed towards the door, a counter with a digital or other type of display which records the number of successive openings and/or closures of the compartment. The plate advantageously carries, in addition, a light-emitting diode in order to indicate the presence or absence of the means of access in its housing. Similarly, the intermediate plate advantageously comprises a loudspeaker which gives an audible alarm when the compartment is opened, which loudspeaker is connected at the back of the plate with an adjustable amplification and command circuit.

According to yet another characteristic of the cabinet according to the invention, the compartment comprises, between the intermediate plate and its back, a reserve battery or the independent power supply for the members of the cabinet and a barrel for receiving a key or similar object for resetting the display counter to zero.

In addition, the compartment preferably comprises, a date display, mounted on the intermediate plate and possibly connected to a recorder, of the printer type, capable of storing the movements of the means of access in and out of its housing.

According to another particular characteristic of the cabinet in question, the shutter for protecting the means of access is mounted so as to swing about an axis and controls in its movement a three-position contact, giving, respectively, information on the presence of the means of access in its housing, on its withdrawal and, finally, on its possible incorrect positioning, the contact being in series with the command circuit of the electromagnet closing the door.

The means for opening the door of the compartment preferably consists of a key, a badge, a digital code keyboard or an infrared wave receiver carried by the outer face of the door. An electrical contact is advantageously provided for controlling the opening of the door and is, to this end, mounted between the latter and the part of the compartment against which it rests in the closed position.

Other characteristics of a security cabinet constructed in accordance with the invention will become clearer via the following description of an illustrative embodiment given hereinafter by way of indication and which is in no way limiting, with reference to the appended drawings, in which.

Figure 1:
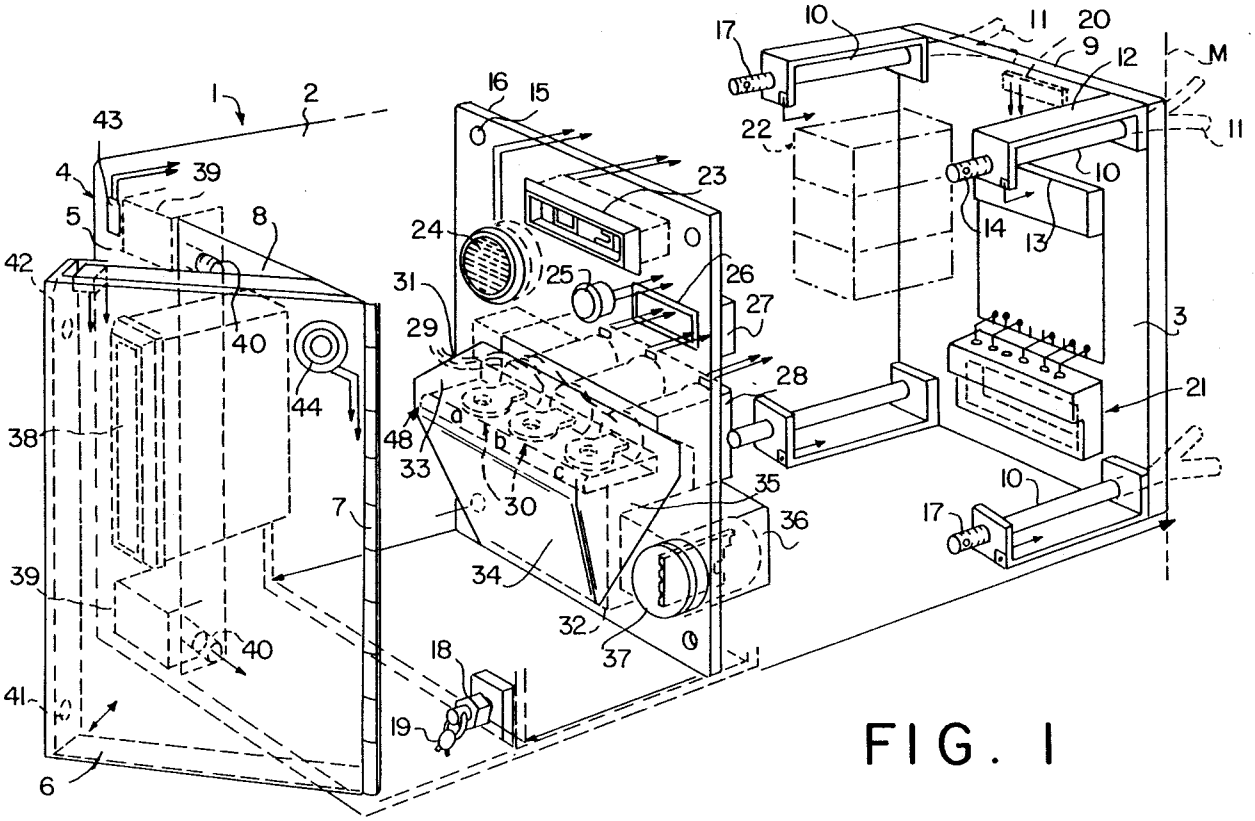
FIG. 1 is an exploded perspective view of a security cabinet according to the invention.
Figure 2:
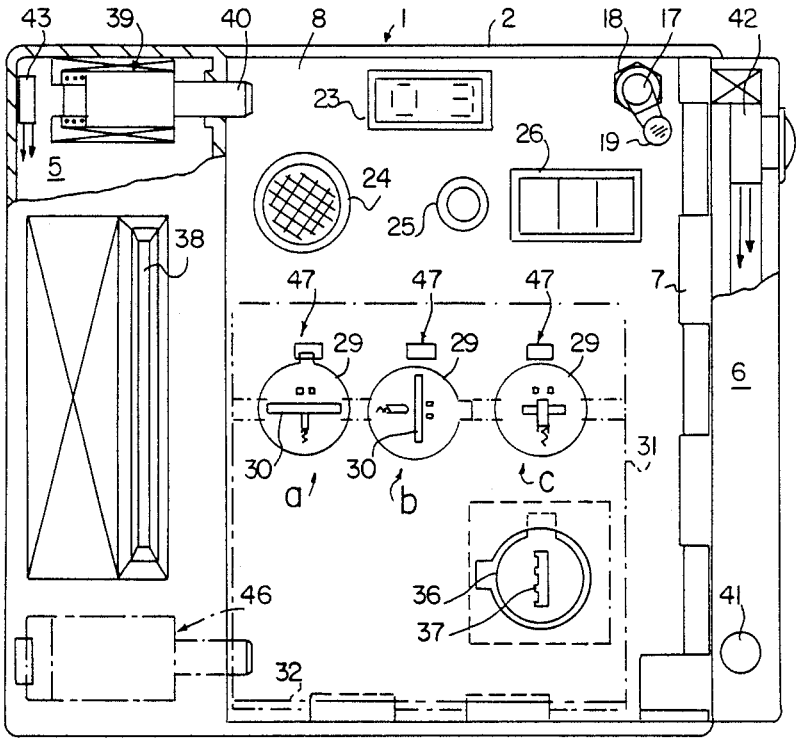
FIG. 2 is a front view on larger scale of the compartment of the cabinet, the door of this compartment being shown in the open position.

As may be seen more particularly in FIGS. 1 and 2, the cabinet in question essentially consists of a compartment 1, generally made of metal, with walls which are sufficiently strong so as to resist an external attack. This compartment 1 comprises lateral walls 2, a back wall 3 intended to be applied against a wall or support surface M, and opposite the latter, a front wall 4 having a flange 5 turned back towards the inside and a pivoting door 6 mounted so as to articulate about hinges 7 in order to, according to the circumstances, permit opening or closing of an opening 8 giving access to the inside of the compartment. The outer face 9 of the back plate 3, applied against the wall M, has anchoring studs 10, preferably four in number, passing through it and arranged at the four corners of the back, these studs having a flared part 11 at their end which penetrates into the wall. They are supported on the inside of the compartment 1 on the other side of the back 3, by brackets 12 which are welded onto this back and have an end shoulder 13. At the end, each stud 10 which passes through the corresponding shoulder 13, has a thread 14 which, after passing through a hole 15 provided in the opposite corners of an intermediate plate 16, which is parallel but separate from the back 3, has a transverse drilled hole 17 which makes it possible, after assembly and immobilization of the studs on the brackets by means of a nut 18 screwed onto their threaded part 14, to fit a lead seal or fastening 19 suitable for controlling the inviolability of the cabinet and, in particular, its possible wrenching from the wall M. A contactor 20 is advantageously provided in the outer face 9 of the back 3 making it possible, in the event that the compartment is detached from the wall M following an attempt at wrenching, to provide an appropriate signal to a central control point (not shown) located in the immediate vicinity of the cabinet or, if appropriate, remote from the latter.

In addition, a terminal or connecting block 21 is provided on the inner face of the back 3, to which all the electrical connections for the apparatus fitted in the compartment lead, it being possible for these connections to be connected to the central control point in order to permit, as stated hereinbelow, suitable management of all the parameters governing the use of the cabinet and of the members it encloses.

Between the intermediate plate 16 and back 3, the brackets 12 thus make it possible to reserve sufficient space to fit, beside the terminal 21, a reserve battery 22 which forms an independent source of electrical power to the cabinet which may, in normal operation, be supplied by the mains network. In addition, and on the opposite face of the plate 16, there is provided a counter 23 with a digital or similar type of display, which makes it possible, in particular, to record the number of successive openings or closures of the pivoting door 6 giving access to the inside of the cabinet. In addition, this intermediate plate 16 carries a loudspeaker 24 acting as an alarm in the event of authorized or unauthorized operation of the apparatus with, at the rear of the plate, its command and amplification circuit, a light-emitting diode 25 and, finally, a time display 26, if appropriate connected to a printer 27 which makes it possible to record the various parameters governing the operation of the compartment.

A casing 28 is mounted on the front of the plate 16 and is equipped with a set of parallel barrels or housings 29 which are each suitable for receiving a means of access 30, in this case a key, making it possible to open or close a housing or other enclosure which is separate from the compartment 1 and in respect of which it is desired at all times and according to the invention to be able to identify the means of access which has been used, the time of this use and the identity of the user.

In the illustrative embodiment shown, the means of access thereby contained in the compartment 1, in this case three in number, are diagrammatically denoted by the references a, b, c. Of course, it goes without saying that the security cabinet in question could provide for the use of any number of such means, this number itself being independent of the invention and having no directly limiting character.

Figure 3:
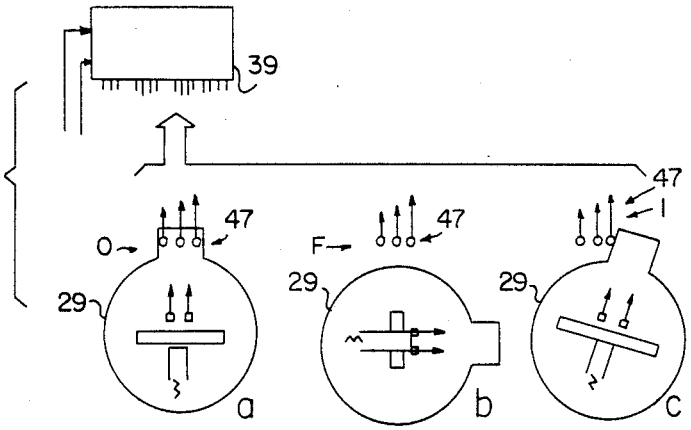
FIG. 3 is a block diagram illustrating diagrammatically the housings intended to receive the means of access contained in the cabinet, and the contactor which controls the positioning of each means in the corresponding housing.
Figure 4:
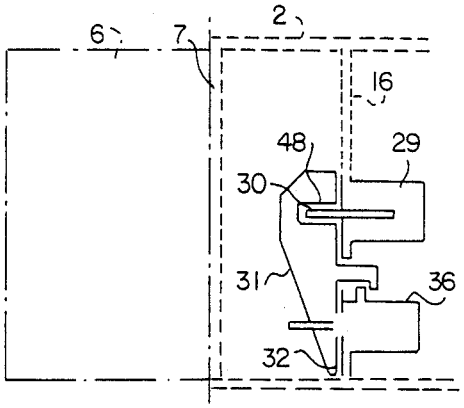
FIG. 4 is a view on a smaller scale, in profile, illustrating the structure of the protective shutter provided inside the compartment.

The means of access 30 are normally arranged inside a pivoting protective shutter 31 mounted so as to articulate about an axis 32 carried by the intermediate plate 16. This shutter 31 comprises two inclined front faces, 33 and 34 respectively, and lateral walls 35. In addition, the means of access 30 engaged in their housings 29 under the shutter 31 are arranged such that, according to the circumstances, they close off one of the positions of a three-terminal contactor, diagrammatically represented in FIG. 3, corresponding to the opening (O), the closure (F) or an intermediate position (I), the key, in this case, being not totally engaged in or withdrawn from its housing. The diode 25 makes it possible, in particular, to indicate whether the key 30 is in one or the other of these positions, for example by being lit up if the key is withdrawn.

The intermediate plate 16 finally comprises a device 36 for resetting the counters and other indicating members of the cabinet to zero, comprising a barrel 37 for engaging a special adapted key available only, for example, to a user responsible for verifying and recording the indications of the cabinet after a specific period of use.

In the turned-back flange 5 of the front face 4 of the compartment 1, there is further provided the access 38 to a means of commanding the opening of the door 6, in this case, in particular, a magnetic card which permits an authorized user, having such a card available, to automatically cause the activation of an electromagnet 39 housed in the compartment 1. This electromagnet therefore attracts a locking bolt 40 which is capable of interacting with a catch 41 provided in the door 6 in order to close the latter when the bolt has emerged or, on the other hand, when the electromagnet is activated, to attract this bolt, thereby releasing the catch 41 and the door 6 which may therefore pivot on the hinges 7, releasing the access opening 8. Contacts 42 and 43 respectively are provided on the inner face of the door 6 and the flange 5 of the compartment 1 in order to automatically detect the positions of opening or of closure of the door. A second light-emitting diode 44 or another indicator of the same type may also be provided on the front face of the door 6 in order to indicate the positions of opening or of closure of the latter. In FIG. 1, all the electrical apparatus of the cabinet, in particular the counter 23, the loudspeaker 24, the diodes 25 and 44, the time display 26, the contacts 20, 42 and 43 etc. are each represented with two electrical connecting conductors, all connected to the block 21 via suitable cabling.

FIG. 2 shows, in more detail, the structure of the electromagnet 39. In particular, it may be seen that the bolt 40 is preferably permanently subject to the action of a spring 45 intended to make it permanently project towards the outside in order to engage in the catch 41 when the coil of this electromagnet is not activated. On the other hand, when the electromagnet is activated, the bolt 40 is attracted counter to the spring 45, therefore releasing the door 6. A second electromagnet 46 may advantageously be provided and this will operate in parallel with the electromagnet 39 in order to ensure better locking of the door at its two ends.

In FIG. 2, the reference 47 also shows the three-position contact (O, F or I) associated with each housing 29 receiving a key 30 in order to control the open, closed or intermediate position of this key. This contactor 47 is, in particular, mounted in the circuit of the electromagnet 39 such that the opening of the door can take place only if the key is suitably engaged in its housing and brought into a closed position (F). In an open (O) or intermediate (I) position, the door cannot be put back into position, since the head of the key blocks the shutter 31 in its median part 48, partially pushing back the shutter and preventing the closure of the door by the bolt 40.

Figure 5:
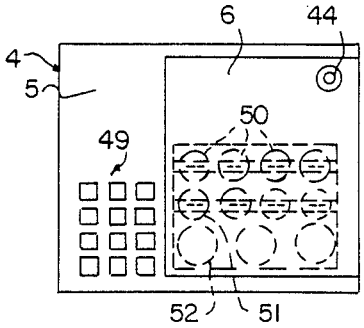
FIGS. 5 and 6 illustrate two alternative embodiments of the door arranged in front of the compartment of the cabinet according to the invention.
Figure 6:
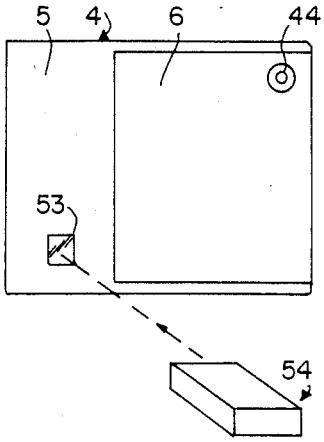

FIGS. 5 and 6 illustrate other alternative embodiments of the means 38 of opening the door 6 of the cabinet according to the invention. In FIG. 5, the flange 5 of the front face 4 therefore comprises a keyboard 49 with keys which makes it possible to command the electromagnet after entering a specific code. Similarly, the front face of the door 6 may comprise barrels 50, 51, 52, respectively, each capable of receiving a suitable key, each of which is associated with a particular user, thereby distinguishing each of the potential users from one another. In the alternative embodiment of FIG. 6, the door 6 may be opened by means of an infrared ray receiver 53 commanded remotely by an emitter 54 which is also available only to authorized users.

The cabinet according to the invention constructed in this manner makes it possible to ensure simple and complete management of the movement of all the access means 30 enclosed inside the compartment 1, authorizing the opening of the latter only by authorized persons who, holding the means (38, 49, 50, . . . ) of opening the door 6, may alone reach one of the means of access 30. Withdrawal of one of these means outside the corresponding housing 29, once the shutter 31 has been removed, may then be strictly recorded and controlled, the cabinet making it possible, in particular, to count the successive openings and closures of the compartment, to record the time and the identity of the user who has withdrawn the said means and control the time of use, the time that it is put back in place and, also, to verify its correct engagement in the corresponding housing and the closure of the door. It should be noted that the door may be closed only if the means of access is correctly replaced, since only then does the contact 47 authorize the manoeuvering of the electromagnet 39 and final closure.

The security cabinet in question therefore makes it possible to provide and to store all the information necessary for the purposes of permanently knowing who has used a means of access, which one, at what time, who has put it back in position and at what time, making it possible, in addition, to determine the identity of the user and to verify his authorization.

Of course, it goes without saying that the invention is not limited to the illustrative embodiment described and represented more particularly hereinabove; on the contrary, it encompasses all the alternative embodiments therefor. Therefore, it may be easily understood that the characteristics of the invention may be applied in the same manner if the cabinet encloses, instead of means of access such as keys, other articles whose use must be controlled and reserved for certain users only, under conditions which must also be determined. Therefore, it is possible to envisage the cabinet containing weapons held vertically inside the cabinet between a fixed support immobilizing, for example, their butt and their lower part and an upper collar surrounding their barrel, this collar consisting of two parts, one of which is fixed and carried by the intermediate plate of the cabinet and the other of which is moveable and which forms a pivoting shutter associated with an electromagnetic, mechanical or other mechanism ensuring its immobilization when the collar is closed. The pivoting shutter may therefore be released only by opening the collar only under authorized specific conditions, making it possible for the user to release the corresponding weapon from the cabinet, the latter making it possible to know permanently who has taken the said weapon, at what time, for what period of time before it was replaced, etc.

In the same manner, provision could be made for other equivalent uses, for example for the temporary immobilizing and conditional release of any objects which may be made available only to authorized persons, such as skis or other articles necessary for sports inside premises used or frequented by a group of people, avoiding the unauthorized use and even the theft of these articles.

I claim:

1. A security cabinet, including a compartment comprising on a front portion thereof a door, a bolt for normally maintaining said door in a closed position and released by at least one electromagnet, an opening means for activating said electromagnet and opening the door, and a back wall opposite the door, the improvement comprising at least one housing arranged inside the compartment supported on an intermediate plate, said intermediate plate being parallel but separate from the back wall of the compartment, at least one protected means for accessing said compartment including a protective shutter received in said at least one housing and which may be withdrawn from said housing only after opening the door and the releasing of said protective shutter of said means for accessing, the intermediate plate carrying members for the control and counting movements of the means for accessing with respect to said housing and for verifying predetermined parameters capable of authorizing the withdrawal of said means for accessing and controlling correct replacement in said housing before closure of the door, and further comprising a supply circuit for energizing said electromagnet to command the bolt to control said door, and a three-position contact connected in series with said supply circuit, said protective shutter being mounted so as to swing about an axis and triggering in its movement about said axis said three-position contact giving, respectively, information on the presence of he means for accessing in said housing, withdrawal of the means for accessing from said housing, and incorrect positioning of said means for accessing in said housing.

2. The security cabinet according to claim 1, wherein the back wall of the compartment comprises fixing brackets carrying studs for anchoring the compartment on a support surface, said studs having threaded ends located inside the compartment, which associate with nuts for immobilizing the compartment and which are not accessible from the outside when the door is closed.

3. The security cabinet according to claim 2, wherein each of the fixing studs comprise at ends thereof a drilled hole for the installation of an unbreakable lead seal in order to control wrenching of the cabinet with respect to the support surface.

4. The security cabinet according to claim 2, wherein the compartment further comprises, between its back wall and the support surface, an electrical contact linked to a central control point located remotely or nearby said security cabinet, for recording any possible movement of the compartment.

5. The security cabinet according to claim 1, wherein the back wall of the compartment comprises a connection block for allowing passage of electrical connection conductors into the cabinet.

6. The security cabinet according to claim 1, wherein the intermediate plate carries in a face directed towards the door a counter having a digital display which records the number of openings and closings of the compartment.

7. The security cabinet according to claim 1, wherein the intermediate plate also carries a light-emitting diode indicating the presence or absence of the means of access in its housing.

8. The security cabinet according to claim 1, wherein the intermediate plate carries a loudspeaker giving an audible alarm, and includes an adjustable command and amplification circuit.

9. The security cabinet according to claim 1, wherein between the intermediate plate and the back wall of the compartment, there is housed an independent reserve battery for the electrical members of the cabinet.

10. The security cabinet according to claim 6, wherein the intermediate plate carries a barrel for a key for resetting a display counter to zero.

11. The security cabinet according to claim 1, and further comprising a time display mounted on the intermediate plate and connected to a printer.

12. The security cabinet according to claim 1, said opening means comprises a key, a badge, a keyboard with a digital code, or an infrared ray emitter supported on a front face of the compartment.

13. The security cabinet according to claim 1, and further comprising a further electrical contact and an indicating light-emitting diode connected to said further electrical contact, said further electrical contact being provided between the door and the compartment for controlling the opening or the closing of the door.

* * * * *